US010086913B2

(12) United States Patent
Fafard

(10) Patent No.: US 10,086,913 B2
(45) Date of Patent: Oct. 2, 2018

(54) ADJUSTABLE PLATFORM FOR A WATERCRAFT

(71) Applicant: Chaparral Boats, Inc., Nashville, GA (US)

(72) Inventor: Michael J. Fafard, Nashville, GA (US)

(73) Assignee: Chaparral Boats, Inc., Nashville, GA (US)

( * ) Notice: Subject to any disclaimer, the term of this patent is extended or adjusted under 35 U.S.C. 154(b) by 0 days.

(21) Appl. No.: 15/348,362

(22) Filed: Nov. 10, 2016

(65) Prior Publication Data

US 2017/0129573 A1 May 11, 2017

Related U.S. Application Data

(60) Provisional application No. 62/253,200, filed on Nov. 10, 2015.

(51) Int. Cl.
*B63B 17/00* (2006.01)
*B63B 27/14* (2006.01)

(52) U.S. Cl.
CPC ..... *B63B 27/14* (2013.01)

(58) Field of Classification Search
CPC ..... B63B 27/14; B63B 27/143
USPC ..... 114/362
See application file for complete search history.

(56) References Cited

U.S. PATENT DOCUMENTS

| | | | | |
|---|---|---|---|---|
| 5,085,164 | A | 2/1992 | Whitton | |
| 5,572,944 | A | 11/1996 | Slikkers | |
| 7,341,016 | B2 | 3/2008 | Terleski | |
| 7,735,441 | B2 * | 6/2010 | Borum | B63B 27/16 114/259 |
| 8,479,677 | B2 * | 7/2013 | Bolline | B63B 27/36 114/362 |
| 8,596,213 | B2 * | 12/2013 | Greenwood | B63B 27/36 114/259 |
| 9,422,031 | B2 * | 8/2016 | Roncarolo | B63B 23/40 |

* cited by examiner

*Primary Examiner* — Anthony D Wiest
(74) *Attorney, Agent, or Firm* — Fish & Richardson P.C.

(57) ABSTRACT

Boats can include an elevation-adjustable platform. For example, some boats can include an aft swim platform that is elevation-adjustable to facilitate convenient movement of people between the boat and the water. The elevation-adjustable platforms can be integrally manufactured as an extension to the hull or deck of a new boat, or manufactured separately and subsequently affixed to a previously manufactured boat.

9 Claims, 4 Drawing Sheets

ADJUSTABLE PLATFORM FOR A WATERCRAFT

CROSS-REFERENCE TO RELATED APPLICATIONS

This application claims the benefit under 35 U.S.C. § 119(e) of U.S. Patent Application No. 62/253,200, entitled "ADJUSTABLE PLATFORM FOR A WATERCRAFT," filed Nov. 10, 2015. The disclosure of the foregoing application is incorporated herein by reference in its entirety for all purposes.

BACKGROUND

This document relates to devices and systems for boating. For example, this document relates to boat platforms that can be selectively raised and lowered in relation to the boat and the water level. In some implementations, the boat platforms are configured as elevation-adjustable swim platforms attached to an aft portion of a boat.

Platforms of various types can be attached to a boat. For example, in some cases a particular type of platform known as a swim platform is attached to an aft portion of a boat. Swim platforms generally provide a means by which people can move between the boat and the water. Swim platforms are typically stationary in relation to the boat, and located above the waterline.

SUMMARY

Some platforms described herein are configured for mounting to a boat using an elevation-adjustable linkage. Elevation-adjustable linkages allow the platform to be selectively raised and lowered in relation to the boat, and also in relation to the waterline. For example, the elevation-adjustable linkages can enable the platform to be lowered below the water level. The elevation-adjustable feature enhances the utility of the platform because, for example, while the platform is in a lowered position a swimmer can more easily get on board the boat. Some linkages described herein facilitate vertical movement of the platforms while maintaining a generally consistent angular orientation of the surface of the platform in relation to the boat and the water level. Accordingly, the linkages allow the surface of the swim platform to oriented in a preferred angular orientation across a range of different elevation levels.

In one implementation, an elevation-adjustable boat platform assembly includes a platform member, a first linkage, a second linkage, a first linear actuator, and a second linear actuator. The first linkage includes a first platform mounting plate attached to the platform member and a first boat mounting plate configured for attachment to a boat. The second linkage includes a second platform mounting plate attached to the platform member and a second boat mounting plate configured for attachment to the boat. A first end of the first linear actuator is pivotably attached to the first linkage and a second end of the first linear actuator is configured for attachment to the boat. A first end of the second linear actuator is pivotably attached to the second linkage and a second end of the second linear actuator is configured for attachment to the boat.

Such an elevation-adjustable boat platform assembly may optionally include one or more of the following features. The platform member may comprise fiberglass. Each of the first boat mounting plate, the second boat mounting plate, the second end of the first linear actuator, and the second end of the second linear actuator may be configured to be attached to an aft portion of the boat. The platform member may comprise a top deck portion configured for supporting a human. The first linkage may include a first main pivot arm that extends between the first boat mounting plate and the first platform mounting plate. The second linkage may include a second main pivot arm that extends between the second boat mounting plate and the second platform mounting plate. The first linkage may include a first supplemental pivot arm, a second supplemental pivot arm, and a third supplemental pivot arm. A first end of the first supplemental pivot arm may be pivotably attached to the first boat mounting plate. A second end of the first supplemental pivot arm may be pivotably attached to a first end of the second supplemental pivot arm. A second end of the second supplemental pivot arm may be pivotably attached to a first end of the third supplemental pivot arm. A second end of the third supplemental pivot arm may be pivotably attached to the first platform mounting plate. The second supplemental pivot arm may be pivotably attached to the first main pivot arm.

In another implementation, a boat includes a hull and an elevation-adjustable boat platform assembly extending from or integrated with the hull. The elevation-adjustable boat platform assembly includes a platform member, a first linkage, a second linkage, a first linear actuator, and a second linear actuator. The first linkage includes a first platform mounting plate attached to the platform member and a first boat mounting plate attached to the boat. The second linkage includes a second platform mounting plate attached to the platform member and a second boat mounting plate attached to the boat. A first end of the first linear actuator is pivotably attached to the first linkage and a second end of the first linear actuator is pivotably attached to the boat. A first end of the second linear actuator is pivotably attached to the second linkage and a second end of the second linear actuator is pivotably attached to the boat.

Such a boat may optionally include one or more of the following features. Extending and retracting the first linear actuator and the second linear actuator may cause an elevation of the platform member in relation to the hull to change. An angular orientation of the platform member in relation to the hull may be essentially constant while the elevation of the platform member in relation to the hull changes. The first linkage may include a first main pivot arm that extends between the first boat mounting plate and the first platform mounting plate. The second linkage may include a second main pivot arm that extends between the second boat mounting plate and the second platform mounting plate. The first linkage may include a first supplemental pivot arm, a second supplemental pivot arm, and a third supplemental pivot arm. A first end of the first supplemental pivot arm may be pivotably attached to the first boat mounting plate. A second end of the first supplemental pivot arm may be pivotably attached to a first end of the second supplemental pivot arm. A second end of the second supplemental pivot arm may be pivotably attached to a first end of the third supplemental pivot arm. A second end of the third supplemental pivot arm may be pivotably attached to the first platform mounting plate.

In another implementation, a boat platform assembly includes a platform member and a framework attached to the platform member and configured for attachment to a boat. The framework is configured for raising and lowering the platform member in relation to the boat. Optionally, the framework can be configured such that an angular orientation of the platform member in relation to the boat remains essentially constant while the platform member is raised and lowered.

Particular embodiments of the subject matter described in this document can be implemented to realize one or more of the following advantages. First, in some implementations the elevation-adjustable boat platforms described herein advantageously facilitate convenient movement of people between the boat and the water. For example, when access to the boat from the water is desired, the boat platform can be lowered (e.g., to below the waterline in some embodiments). Such an arrangement can allow a swimmer easier access to the boat from the water as compared to a traditional fixed/immovable swim platform.

Second, some implementations of the boat platforms can be advantageously used in conjunction with virtually any type and size of boat, such as jet boats, sterndrive boats, inboard boats, outboard boats, sailboats, and so on.

Third, in some implementations the boat platforms described herein can be integrally manufactured as part of a boat during the manufacturing process of the boat. Alternatively, in some implementations the boat platforms described herein can be individually made and advantageously attached to a portion of a previously existing boat. Hence, an individual may be able to purchase one of the elevation-adjustable boat platforms described herein and add it onto the previously existing boat.

Fourth, the elevation-adjustable boat platforms described herein can be raised so that the platform does not drag in the water while boat is in motion. Hence, the boat's top speed and fuel economy are not detrimentally affected by the presence of the elevation-adjustable boat platforms described herein.

Fifth, in some implementations the boat platforms described herein can increase the overall deck space of a boat to which the boat platform is attached. Increasing the deck space may lead to greater user enjoyment and enhanced safety of the boat.

Activities such as swimming, water skiing, accessing adjacent watercraft, docking, and so forth can be made more convenient utilizing a swim platform. For example, one particular advantage of swim platforms is to facilitate easier movement by swimmers into and out of the water, as opposed to having to climb over the gunwales or stern of the boat's hull. Moreover, swim platforms can enhance boating safety by providing an access to and from the boat that is located farther away from the boat's propeller as compared to a boat without a swim platform.

Although methods and materials similar or equivalent to those described herein can be used to practice the invention, suitable methods and materials are described herein. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments of the invention are set forth in the accompanying drawings and the description herein. Other features, objects, and advantages of the invention will be apparent from the description and drawings, and from the claims.

DESCRIPTION OF THE DRAWINGS

Like reference numbers represent corresponding parts throughout.

DETAILED DESCRIPTION

This document provides devices and systems for boating. For example, this document provides boat platforms that can be selectively raised and lowered in relation to the boat and the water level. In some implementations, the boat platforms are configured as elevation-adjustable swim platforms attached to an aft portion of a boat.

Figure 1:
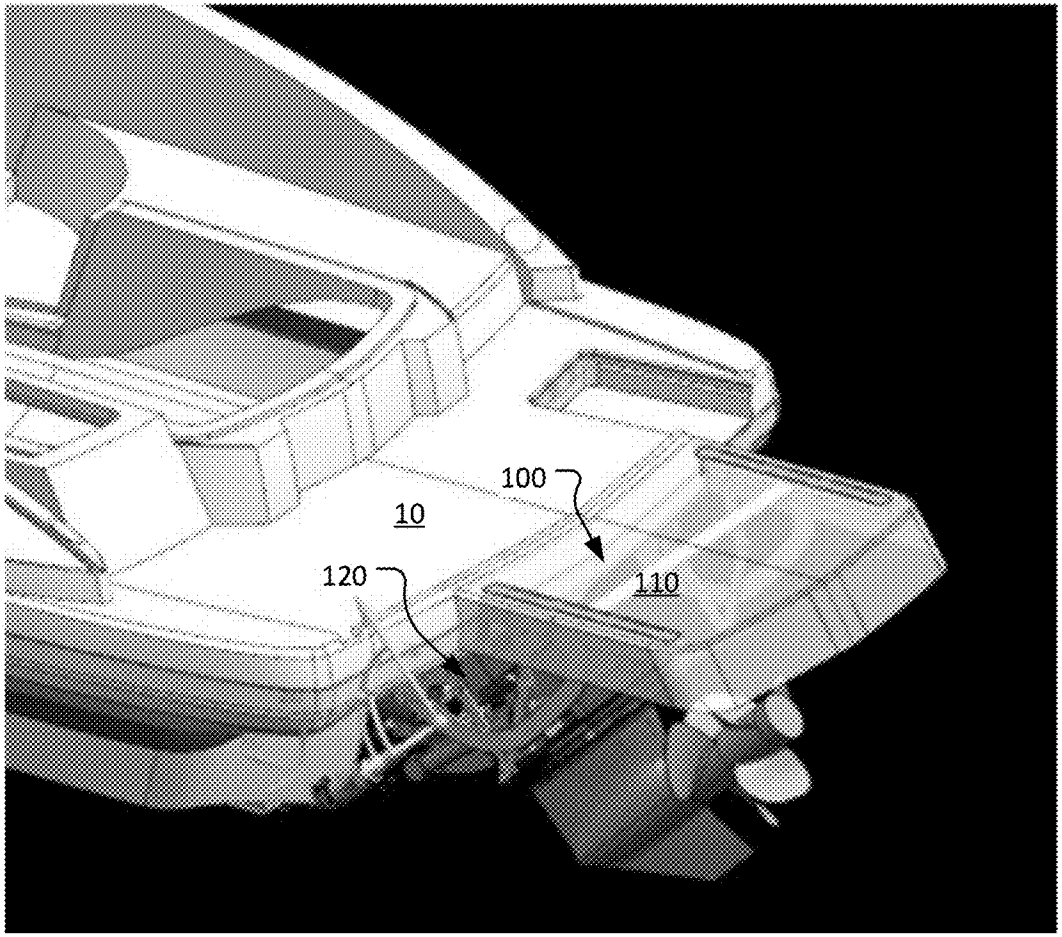
FIG. 1 is a perspective view of a boat-mounted elevation-adjustable aft swim platform in accordance with some embodiments. The elevation-adjustable aft swim platform is shown in a fully raised orientation.

Referring to FIG. 1, a boat 10 includes an example elevation-adjustable swim platform assembly 100 extending from an aft portion of the boat 10. The example swim platform assembly 100 includes a platform member 110 and two linkages 120. The linkages 120 are attached to the hull, transom, or deck of the boat 10, and also attached to the platform member 110. Hence, the linkages 120 are the mechanical means interconnecting the platform member 110 to the boat 10. As described further below, the linkages 120 facilitate the raising and lowering of the platform member 110 in relation to other portions of the boat 10.

While in the depicted embodiment the elevation-adjustable swim platform assembly 100 is located aft in relation to the boat 10, such an arrangement is not required in all embodiments. For example, in some embodiments, the elevation-adjustable swim platform assembly 100 is located on a side of the boat 10, or the bow of the boat 10. In some embodiments, two or more elevation-adjustable swim platform assemblies 100 can be included on a single boat 10.

In some embodiments, the elevation-adjustable swim platform assembly 100 is arranged in relation to the boat 10 such that the platform member 110 can be positioned essentially level (flush) with an adjacent portion of decking of the boat 10. For example, in the depicted embodiment the platform member 110 is essentially level with a rear deck of the boat 10. Of course, as will be described further below, the platform member 110 can be lowered from the depicted arrangement. In some embodiments, when the elevation-adjustable swim platform assembly 100 is located on a side or bow of the boat 10, the platform member 110 can be positioned such that the platform member 110 is essentially level (flush) with an adjacent portion of decking of the boat 10. For example, in some embodiments the platform member 110 can be recessed and/or essentially integrated into the decking of the boat when the elevation-adjustable swim platform assembly 100 is raised to a particular level.

While in the depicted embodiment, the elevation-adjustable swim platform assembly 100 extends along only a portion of the width of the boat 10, in some embodiments the elevation-adjustable swim platform assembly 100 extends along the entire width of the boat 10, or extends beyond the entire width of the boat 10. It should be understood that the elevation-adjustable swim platform assembly 100 is scalable to be any width, length, and shape as desired. While in the depicted embodiment the platform member 110 has a planar top surface, the platform member 110 does not need to have a unitarily planar top surface in all embodiments. For example, in some embodiments the platform member has two or more portions that are at differing elevations (e.g., like steps).

In the depicted embodiment, the boat 10 is a sterndrive arrangement. It should be understood that the elevation-adjustable swim platform assembly 100 can be adapted to other types of boats. For example, the elevation-adjustable swim platform assembly 100 can be mounted to an inboard, outboard, jet boat, and other types of powerboats. The elevation-adjustable swim platform assembly 100 can be used in conjunction with boats of various sizes. In some embodiments, the elevation-adjustable swim platform assembly 100 can be mounted to a personal watercraft, a sailboat, a catamaran, a dingy, a pontoon or deck boat, hydrofoil, and other types of boats.

In some embodiments, the elevation-adjustable swim platform assembly 100 is integrated with the boat 10 as part of the manufacturing process of the boat 10. Alternatively, in some embodiments the elevation-adjustable swim platform assembly 100 is added onto a previously existing boat 10 as an aftermarket accessory.

Figure 2:
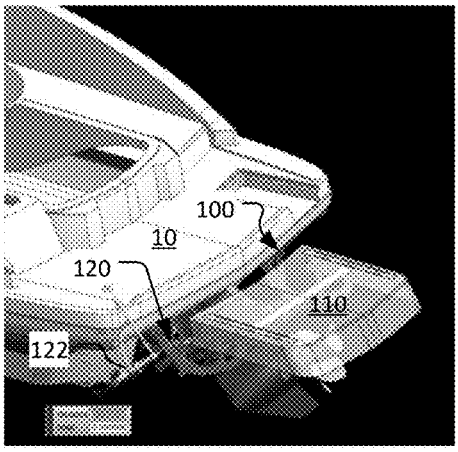
FIG. 2 is a perspective view of the boat-mounted elevation-adjustable aft swim platform of FIG. 1 shown in a first partially lowered orientation.
Figure 3:
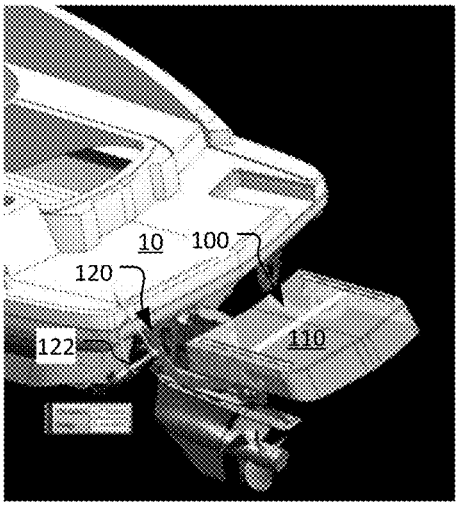
FIG. 3 is a perspective view of the boat-mounted elevation-adjustable aft swim platform of FIG. 1 shown in a second partially lowered orientation.
Figure 4:
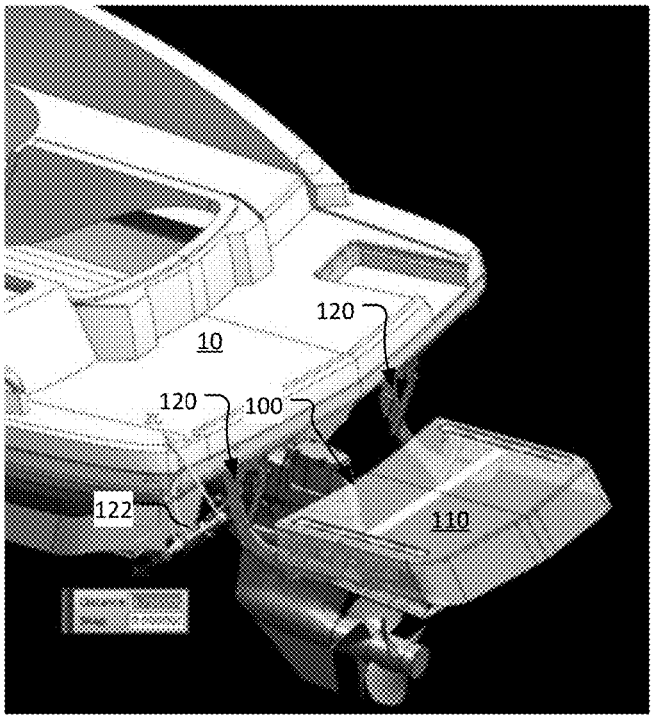
FIG. 4 is a perspective view of the boat-mounted elevation-adjustable aft swim platform of FIG. 1 shown in a fully lowered orientation.
Figure 5:
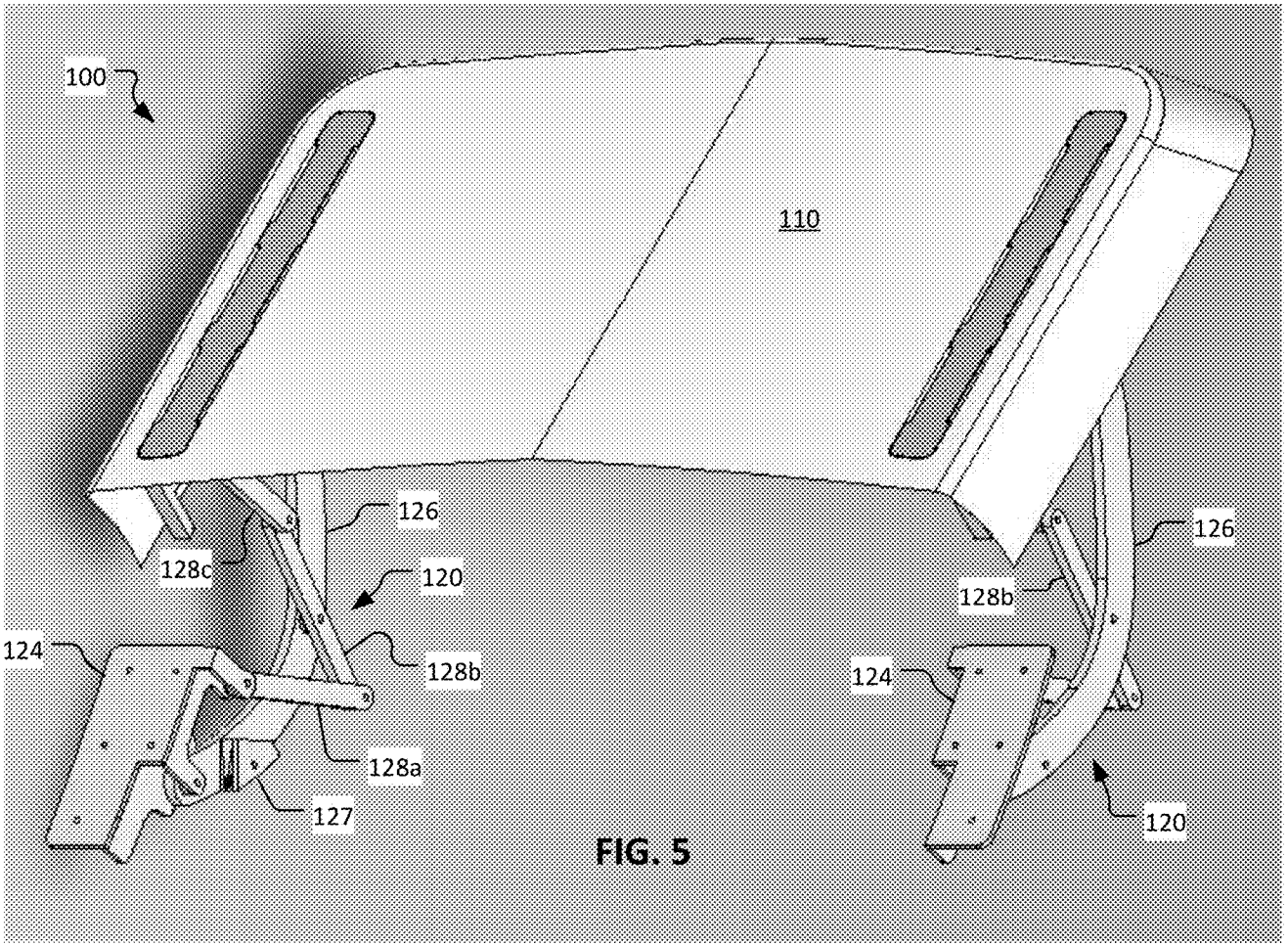
FIG. 5 is a perspective view of an elevation-adjustable boat platform assembly in accordance with some embodiments.
Figure 7:
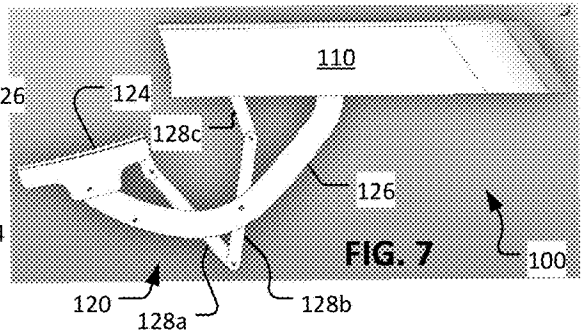
FIG. 7 is a port side view of the elevation-adjustable boat platform assembly of FIG. 5.
Figure 6:
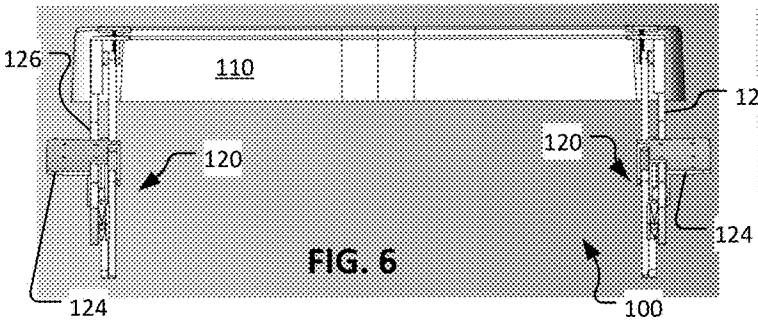
FIG. 6 is an end view of the elevation-adjustable boat platform assembly of FIG. 5.
Figure 8:
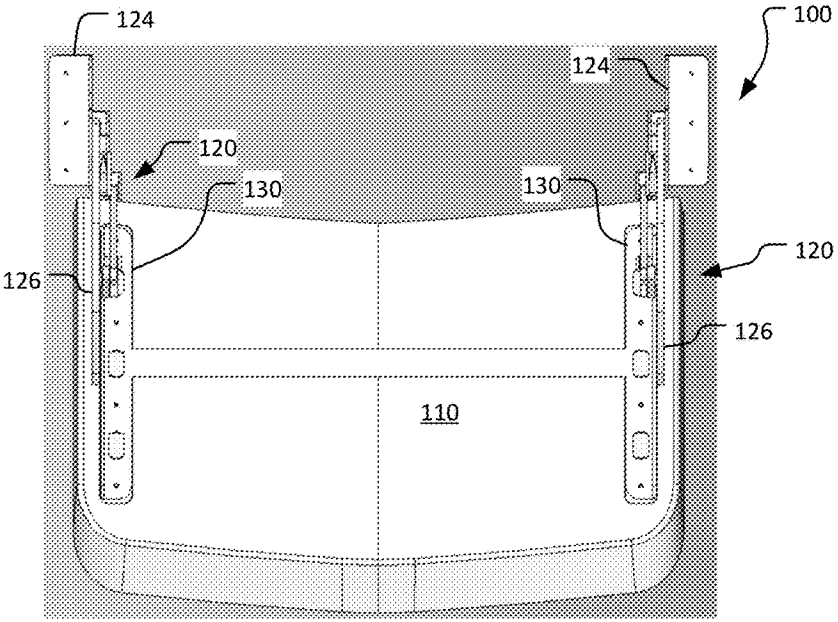
FIG. 8 is an underside view of the elevation-adjustable boat platform assembly of FIG. 5.

Referring also to FIGS. 2-4, the elevation-adjustable swim platform assembly 100 can be raised and lowered to a desired elevation in relation to the boat 10 and the waterline. In FIG. 1, the elevation-adjustable swim platform assembly 100 is shown in a fully raised configuration. FIG. 2 shows the elevation-adjustable swim platform assembly 100 in a first lowered configuration. FIG. 3 shows the elevation-adjustable swim platform assembly 100 in a second lowered configuration (lower than the first lowered configuration). FIG. 4 shows the elevation-adjustable swim platform assembly 100 in a third lowered configuration (lower than the second lowered configuration). In some embodiments, the elevation-adjustable swim platform assembly 100 can be selectively positioned to any desired vertical orientation along a continuum of positions between an upper limit (e.g., as shown in FIG. 1) and a lower limit (e.g., as shown in FIG. 4).

In some embodiments, the elevation-adjustable swim platform assembly 100 is designed such that the upper surface of the platform member 110 maintains a substantially consistent angular orientation along its continuum of positions. For example, FIG. 1 shows that, in the upper-most position, the upper surface of the platform member 110 is essentially parallel with the rear deck of the boat 10. As the platform member 110 is lowered (FIGS. 2-4), the parallelism between the platform member 110 and the rear deck of the boat 10 is essentially maintained. As such, users of elevation-adjustable swim platform assembly 100 will be provided with a predictable and, in some embodiments, essentially horizontally level swim platform at all elevations of the elevation-adjustable swim platform assembly 100.

In some embodiments, the linkages 120 include one or more linear actuators 122. In the depicted embodiment, two linear actuators 122 are included as part of the elevation-adjustable swim platform assembly 100 (one for each of the linkages 120). In some embodiments, one, three, four, five, six, or more than six linear actuators 122 are included in the elevation-adjustable swim platform assembly 100.

The linear actuators 122 provide the mechanical force for raising and lowering the platform member 110. One end of each linear actuator 122 is mounted to the boat 10 (e.g., to the transom, hull, or deck). The opposite end of each linear actuator 122 is mounted to the linkage 120. As the linear actuators 122 are extended or retracted, the linkages 120 are forcibly moved in relation to the boat 10. The platform member 110, in turn, is thereby raised or lowered in relation to the boat 10. In the depicted embodiment, an extension of the linear actuators 122 causes the platform member 110 to rise, and a retraction of the linear actuators 122 causes the platform member 110 to lower.

In some embodiments, the linear actuators 122 are hydraulic cylinders. In some embodiments, the linear actuators 122 are electrically motorized. In some embodiments, a rack and pinion arrangement is used as part of the linear actuators 122.

In some embodiments, one or more sensors are included to enhance safe operations of the elevation-adjustable swim platform assembly 100. For example, in some embodiments one or more tape-switches are positioned along the edges of the rear deck and/or platform member 110 to prevent pinching therebetween (by deactivating movement of the linear actuators 122 in response to a triggering of the tape-switches). In some embodiments, one or more optical sensors (or other types or sensors) can similarly be included to enhance safe operations of the elevation-adjustable swim platform assembly 100.

Referring to FIG. 5-8, the example elevation-adjustable swim platform assembly 100 is described in further detail. As described above, the elevation-adjustable swim platform assembly 100 includes the platform member 110 and the linkages 120. One end of each linkage 120 is attached to the platform member 110. The opposite end of each linkage 120 is attachable to a portion of a boat. In these figures, the linear actuators (as described above) are not shown.

The platform member 110 can be made from various types of materials and combinations of materials. For example, in some embodiments the platform member 110 is made of fiberglass, aluminum, stainless steel, wood (e.g., teak), plastics, or combinations thereof. In some embodiments, the platform member 110 is configured for reduced slipperiness (e.g., with one or more high-friction surfaces). In some embodiments, one or more openings exist in the platform member 110 so that water can pass through the platform member 110. For example, in some embodiments the platform member 110 is made at least partially of expanded stainless steel.

The components of linkages 120 can be made from various types of materials and combinations of materials. For example, in some embodiments the components of the linkages 120 are made of stainless steel, aluminum, and the like. The linkages 120 can also include one or more bearings and/or bushings, pins, hinges, and the like, so that the linkages 120 can be reconfigured to cause the platform member 110 to raise and lower.

In the depicted embodiment, the two linkages 120 are configured as mirror images of each other, but that is not a requirement in all embodiments. In some embodiments, the two linkages 120 are configured differently from each other.

In the depicted embodiment, each of the linkages 120 includes a boat mounting plate 124, a main pivot arm 126, a first supplemental pivot arm 128*a*, a second supplemental pivot arm 128*b*, a third supplemental pivot arm 128*c*, and a platform mounting plate 130. First ends of the main pivot arm 126 and the first supplemental pivot arm 128*a* are both pivotably attached to the boat mounting plate 124. Second ends of the main pivot arm 126 and the third supplemental pivot arm 128*c* are both pivotably attached to the platform mounting plate 130. A second end of the first supplemental pivot arm 128*a* is pivotably attached to a first end of the second supplemental pivot arm 128*b*. A second end of the second supplemental pivot arm 128*b* is pivotably attached to a first end of the third supplemental pivot arm 128*c*. In addition, the second supplemental pivot arm 128*b* is pivotably attached to the main pivot arm 126 at approximately the midpoints of the second supplemental pivot arm 128*b* and the main pivot arm 126. It should be understood that other configurations of the linkages 120 are also envisioned within the scope of this disclosure.

The boat mounting plate 124 is configured for attachment to a portion of a boat. In the depicted embodiment, the boat mounting plate 124 is configured to be attached to a generally horizontal portion of a boat. Such an arrangement is not required in all embodiments. For example, in some embodiments the boat mounting plate 124 is configured to be mounted to a generally vertical portion of a boat (e.g., the boat's transom). It should be understood that the boat mounting plate 124 can be configured for mounting at any desired angle in relation to a boat's surface.

The main pivot arm 126 extends between the boat mounting plate 124 and the platform mounting plate 130. In the depicted embodiment, the main pivot arm 126 has a non-linear c-shaped profile. Other configurations of the main pivot arm 126 are also envisioned within the scope of this disclosure. For example, in some embodiments the main pivot arm 126 can be linear, s-shaped, or angular.

Each main pivot arm 126 includes an actuator mounting location 127. The actuator mounting location 127 is a location where an end of a linear actuator can be pivotably coupled with the linkage 120 (the other end the linear actuator can be pivotable coupled with the boat as described above in reference to FIGS. 1-4). Accordingly, the main pivot arm 126 provides the primary mechanical support for the platform member 110. That is, when weight is applied to the platform member 110 (such as from one or more people standing on the platform member 110), much of the force from the platform member 110 is transferred to the main pivot arms 126, then to the linear actuators coupled to the main pivot arms 126, and then to the boat. The boat mounting plates 124 and supplemental pivot arms may also receive some of the force applied to the platform member 110.

The supplemental pivot arms (i.e., the first supplemental pivot arm 128*a*, the second supplemental pivot arm 128*b*, and the third supplemental pivot arm 128*c*) work in concert with the main pivot arm 126 such that a generally consistent angular orientation of the platform member 110 is maintained as the elevation-adjustable swim platform assembly 100 is actuated upward and downward. The second supplemental pivot arm 128*b* is pivotably attached to the main pivot arm 126.

While this specification contains many specific implementation details, these should not be construed as limitations on the scope of any invention or of what may be claimed, but rather as descriptions of features, that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described herein as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described herein should not be understood as requiring such separation in all embodiments, and it should be understood that the described program components and systems can generally be integrated together in a single product or packaged into multiple products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

What is claimed is:

1. An elevation-adjustable boat platform assembly, comprising:

a platform member;

a first linkage, the first linkage including:

a first platform mounting plate attached to the platform member;

a first boat mounting plate configured for attachment to a boat;

a first main pivot arm having a first end pivotably attached to the first boat mounting plate and a second end pivotably attached to the first platform mounting plate; and a first supplemental pivot arm, a second supplemental pivot arm, and a third supplemental pivot arm, wherein a first end of the first supplemental pivot arm is pivotably attached to the first boat mounting plate, wherein a second end of the first supplemental pivot arm is pivotably attached to a first end of the second supplemental pivot arm, wherein a second end of the second supplemental pivot arm is pivotably attached to a first end of the third supplemental pivot arm, and wherein a second end of the third supplemental pivot arm is pivotably attached to the first platform mounting plate a second linkage, the second linkage including:

a second platform mounting plate attached to the platform member;

a second boat mounting plate configured for attachment to the boat; and a second main pivot arm having a first end pivotably attached to the second boat mounting plate and a second end pivotably attached to the second platform mounting plate;

a first linear actuator, a first end of the first linear actuator pivotably attached to the first linkage and a second end of the first linear actuator configured for attachment to the boat; and a second linear actuator, a first end of the second linear actuator pivotably attached to the second linkage and a second end of the second linear actuator configured for attachment to the boat.

2. The elevation-adjustable boat platform assembly of claim 1, wherein the platform member comprises fiberglass.

3. The elevation-adjustable boat platform assembly of claim 1, wherein each of the first boat mounting plate, the second boat mounting plate, the second end of the first linear actuator, and the second end of the second linear actuator are configured to be attached to an aft portion of the boat.

4. The elevation-adjustable boat platform assembly of claim 1, wherein the platform member comprises a top deck portion configured for supporting a human.

5. The elevation-adjustable boat platform assembly of claim 1, wherein the second supplemental pivot arm is pivotably attached to the first main pivot arm.

6. A boat comprising:

a hull; and an elevation-adjustable boat platform assembly extending from or integrated with the hull, the elevation-adjustable boat platform assembly comprising:

a platform member;

a first linkage, the first linkage including: (i) a first platform mounting plate attached to the platform member, (ii) a first boat mounting plate attached to the boat, (iii) a first main pivot arm extending from the first boat mounting plate to the first platform mounting plate; and (iv) a first supplemental pivot arm, a second supplemental pivot arm, and a third supplemental pivot arm, wherein a first end of the first supplemental pivot arm is pivotably attached to the first boat mounting plate, wherein a second end of the first supplemental pivot arm is pivotably attached to a first end of the second supplemental pivot arm, wherein a second end of the second supplemental pivot arm is pivotably attached to a first end of the third supplemental pivot arm, and wherein a second end of the third supplemental pivot arm is pivotably attached to the first platform mounting plate a second linkage, the second linkage including: (i) a second platform mounting plate attached to the platform member, (ii) a second boat mounting plate attached to the boat, and (iii) a second main pivot arm extending from the second boat mounting plate to the second platform mounting plate;

a first linear actuator, a first end of the first linear actuator pivotably attached to the first main pivot arm and a second end of the first linear actuator pivotably attached to the boat; and a second linear actuator, a first end of the second linear actuator pivotably attached to the second main pivot arm and a second end of the second linear actuator pivotably attached to the boat.

7. The boat of claim 6, wherein extending and retracting the first linear actuator and the second linear actuator causes an elevation of the platform member in relation to the hull to change.

8. The boat of claim 7, wherein an angular orientation of the platform member in relation to the hull is essentially constant while the elevation of the platform member in relation to the hull changes.

9. The boat of claim 6, wherein the first main pivot arm is pivotably attached to each of the first boat mounting plate and the first platform mounting plate, and wherein the second main pivot arm is pivotably attached to each of the second boat mounting plate and the second platform mounting plate.

* * * * *